United States Patent [19]

Porter et al.

[11] 4,451,351

[45] May 29, 1984

[54] METHOD OF LIQUEFACTION OF CARBONACEOUS MATERIALS

[75] Inventors: Clifford R. Porter, Arvada, Colo.; Herbert D. Kaesz, Los Angeles, Calif.

[73] Assignee: Pentanyl Technologies, Inc., Boulder, Colo.

[21] Appl. No.: 369,773

[22] Filed: Apr. 19, 1982

Related U.S. Application Data

[63] Continuation-in-part of Ser. No. 207,714, Nov. 17, 1980, Pat. No. 4,325,802.

[51] Int. Cl.[3] ..... C10G 1/06; C10G 1/00; C10B 43/00; C07C 1/00

[52] U.S. Cl. ..... 208/10; 208/8 LE; 201/2.5; 585/240; 568/761

[58] Field of Search ..... 208/10, 108; 201/2.5; 585/240; 568/761

[56] References Cited

U.S. PATENT DOCUMENTS

| | | | |
|---|---|---|---|
| 2,202,901 | 6/1940 | Dreyfus | 208/8 LE X |
| 3,642,607 | 2/1972 | Seitzer | 208/8 LE |
| 3,765,851 | 10/1973 | White | 201/2.5 |
| 3,796,650 | 3/1974 | Urban | 208/10 |
| 3,816,298 | 6/1974 | Aldridge | 208/108 X |
| 3,841,991 | 10/1974 | Cohen et al. | 208/8 |
| 3,960,969 | 6/1976 | Greco et al. | 568/761 X |
| 3,966,585 | 6/1976 | Gray et al. | 208/8 |
| 4,056,460 | 11/1977 | Malek | 208/8 LE |
| 4,085,029 | 4/1978 | Malek | 208/8 LE |
| 4,089,658 | 5/1978 | Bay | 208/8 |
| 4,119,525 | 10/1978 | Gray et al. | 208/8 |
| 4,157,246 | 6/1979 | Eakman et al. | 208/10 X |
| 4,189,371 | 2/1980 | Maa et al. | 208/8 LE |
| 4,202,757 | 5/1980 | Amondale | 208/10 |
| 4,247,384 | 1/1981 | Chen et al. | 208/8 LE |
| 4,266,083 | 5/1981 | Huang | 208/10 X |
| 4,298,450 | 11/1981 | Ross et al. | 208/10 X |
| 4,369,106 | 1/1983 | Aldridge et al. | 208/10 |

FOREIGN PATENT DOCUMENTS

| | | | |
|---|---|---|---|
| 1093102 | 6/1981 | Canada | 201/2.5 |

OTHER PUBLICATIONS

Solvation and Hydrogenation of Coal, Orchin et al., Industrial and Engineering Chemistry, vol. 40, No. 8, 8/48, pp. 1385–1389.

*Primary Examiner*—Delbert E. Gantz
*Assistant Examiner*—William G. Wright
*Attorney, Agent, or Firm*—Jerry W. Berkstresser; Bruce G. Klaas

[57] ABSTRACT

Hydrocarbon liquids are obtained from carbonaceous materials, such as coal, by contacting the carbonaceous materials with a metal carbonyl or a low valent complex of the transition metals and water gas under alkaline conditions to form a reaction mixture, and then heating the reaction mixture to a sufficient temperature and pressure to obtain the hydrocarbon liquids. In a second embodiment, the carbonaceous materials are solubilized to an unexpectedly high degree by contacting them with solvent/solute systems, such as phenolic recycle solvents containing alkali or alkaline-earth metal constituents.

19 Claims, No Drawings

METHOD OF LIQUEFACTION OF CARBONACEOUS MATERIALS

This is a continuation-in-part application of application Ser. No. 207,714, filed Nov. 17, 1980, now U.S. Pat. No. 4,325,802.

BACKGROUND AND SUMMARY OF THE INVENTION

The present invention relates to the liquefaction of carbonaceous materials, and more particularly to a method for the structural degradation and/or hydrogenation of carbonaceous material using solvent systems under alkaline conditions or in the presence of alkali or alkaline-earth metal compounds and water.

With the present world wide emphasis on the energy crisis and increasingly diminishing supplies of readily produceable, naturally occurring petroleum oil and gas reserves, increased attention by both governmental and private organizations is being given alternate energy sources.

Due to the vast resources of coal and other carbonaceous materials available for development in the United States and other countries, it appears that these resources will play an important role in energy supply for the future. However, a significant proportion of the world's coal supply contains a relatively large amount of heteroatoms, such as sulfur and nitrogen, which lead to air pollution and handling problems upon utilization of the raw coal as an energy source. For this reason, processes for obtaining a clean fuel from raw coal are becoming increasingly attractive.

Several processes are known in the art for beneficiating solid carbonaceous materials, such as coal, to reduce impurities. For example, U.S. Pat. Nos. 3,938,966; 4,098,584; 4,119,410; 4,120,665; 4,146,367; and 4,175,924 relate to such processes.

In addition to the use of beneficiated coal, considerable attention has been given to processes for the gasification or liquefaction of coal to produce petroleum-like oils and gaseous products. Coal liquefaction processes exhibit an advantage over coal gasification processes in that the liquid products of a coal liquefaction process generally have higher energy densities, resulting in mining, transportation, storage and utilization savings. Thus, there exists an urgent need for the development of liquefaction processes which are capable of providing liquid fuel products in an economical manner.

The essence of a coal liquefaction process is the structural degradation of, and/or the addition of hydrogen to, a carbonaceous material, with heteroatom removal being an important consideration. In theory, for example, an increase in the hydrogen content of coal of about 2 to 3 percent may result in the production of heavy oils, while an increase in the hydrogen content of coal of about 6 percent or more may result in the production of light oils and gasoline. Present methods for the liquefaction of coal generally include pyrolysis, solvent extraction, direct hydrogenation and indirect hydrogenation. Pyrolysis processes are frequently unattractive due to the high energy inputs required to thermally break down the coal molecule. Solvent extraction utilizes a hydrogen donor solvent system which generally requires a separate step and facilities for catalytic hydrogenation of the solvent system. Indirect liquefaction generally involves reacting coal with steam and oxygen at high temperature to produce gas consisting primarily of hydrogen, carbon monoxide and methane, and then catalytically reacting the hydrogen and carbon monoxide to synthesize hydrocarbon liquids by the Fischer-Tropsch process. Indirect liquefaction processes therefore involve multiple process steps requiring relatively large energy inputs and expensive process facilities. Direct liquefaction processes typically involve the hydrogenation of coal particles with a solid catalyst, such as on a fixed bed catalyst or an ebullated bed catalyst. The use of solid catalyst systems has resulted in additional problems, since it is difficult to obtain contact between the solid phases of the coal and catalyst, and solid catalytic processes frequently suffer from catalyst poisoning.

As can be seen from the foregoing, there are many problems associated with the production of hydrocarbon liquids from solid carbonaceous materials, including the need for expensive high pressure and temperature equipment, relatively low yields which are obtained under economically feasible temperature and pressure conditions, catalyst losses, and the like. However, one of the largest problems hindering commercial development of coal liquefaction processes is economic, due principally to the high cost of hydrogen and capital costs associated with high pressure and temperature equipment. In current practices, the main source of hydrogen is from hydrocarbons, including natural gas, LPG, naphtha, etc. Some current practices, utilize hydrogen donor solvents such as tetralin, to aid in hydrogenation of coal after its chemical structure has been thermally ruptured by high process temperatures. Regardless of the source, the high cost of hydrogen presently makes coal liquefaction economically prohibitive, even in relationship to the high cost of natural crude oil. Moreover, in those processes which rely upon hydrogen donor solvents such as tetralin, coal solubility, which is generally low in such solvents, is an additional problem.

In order to overcome the foregoing problem relating to hydrogen, it has been suggested that the hydrogen requirements for a coal liquefaction process could be obtained from the water gas shift reaction by reacting carbon monoxide and water (i.e., water gas) to form hydrogen and carbon dioxide. Previously suggested catalysts for this reaction in connection with coal liquefaction processes have been primarily solid catalysts such as metal oxides, metal chlorides, metal sulfides and the like, and various combinations of these catalysts. However, these processes have been found to require relatively high temperature and pressures, and to suffer from catalyst poisoning and relatively low yields.

It has now been found that hydrocarbon liquids can be obtained in relatively high yields from carbonaceous materials by contacting the carbonaceous materials with a liquefaction facilitating agent, such as a metal carbonyl or a low valent complex of the transition metals, and water gas under alkaline conditions to form a reaction mixture, and then heating the reaction mixture to a sufficient temperature and pressure to obtain the hydrocarbon liquids. It has also been found that solubility of carbonaceous materials can be significantly enhanced by the use of certain solvent/solute systems, e.g., those comprising one or more phenolic or aromatic alcohol solvents, alkali or alkaline-earth metal compounds and water.

It is known to enhance solubilization of coal and other carbonaceous materials during liquefaction by using a variety of coal derived and other organic solvents. For example, U.S. Pat. No. 4,133,646 teaches the advantages of using phenolic recycle solvents in coal liquefaction. Similar advantages are taught by Kamiya et al., "Effect of Phenolic Compounds On Liquefaction of Coal in the Presence of Hydrogen-Donor Solvent," *Fuel,* Vol. 57 (November 1978), pp. 681–68; and by Sams, et al, "Internal Rearrangement of Hydrogen During Heating of Coals with Phenol;" *Fuel,* Vol. 60 (April 1981) pp. 335–341. It is also known that the presence of various alkali bases, e.g. NaOH, $Na_2CO_3$ and $NHCO_3$, can enhance solubilization and/or liquefaction yields from various carbonaceous materials. See for example, Donovan et al., "Oil Yields from Cellulose Liquefaction," *Fuel,* Vol. 60 (October 1981) pp. 899–902 and Araya et al., "Study of Treatments of Subbituminous Coals by NaOH Solutions," *Fuel,* Vol. 60, December 1981, pp. 1127–1130. However, heretofore the unexpectedly high solubilization possible through the synergistic effect of a solvent/solute system combining a phenolic solvent, water and an added amount of an alkali or alkaline-earth metal compound has gone unrecognized.

Appel et al., in their paper entitled "On the Mechanism of Lignite Liquefaction With Carbon Monoxide and Water" show that using freshly powdered low-rank coal and a proper solvent, a 72% yield of a benzene-soluble oil was obtained at operating pressures near 5000 p.s.i.g. and temperatures in excess of 365° C. Appel et al. also disclose the use of a solvent comprising alpha-naphthol (a phenol), phenanthrene (a polycyclic aromatic hydrocarbon) and water in the presence of naturally occurring amounts of alkali or alkaline-earth metal compounds at the aforementioned operating conditions. They also describe testing with the addition of $K_2CO_3$ in water as a solvent and concluded that the addition of $K_2CO_3$ increases the extent of the water gas shift reaction but does not improve hydrogen utilization or conversion. They did not recognize the unexpectedly beneficial synergistic effect of a solvent/solute system combining a phenolic solvent, water and an added amount of alkali or alkaline-earth metal compound.

Treatments according to the present invention can additionally result in the reduction or removal of sulfur, nitrogen and similar heteroatoms, thereby providing a clean burning liquid fuel energy source.

DESCRIPTION OF ILLUSTRATIVE EMBODIMENTS

As used herein, the term "carbonaceous material" includes solid, semi-solid and liquid organic materials which are susceptible to the treatment method. Examples of solid carbonaceous materials which may be used in connection with the practice of the invention include coal, such as anthracite, bituminous, subbituminous and lignite coals, as well as other solid carbonaceous materials, such as wood, lignin, peat, solid petroleum residuals, solid carbonaceous materials derived from coal, and the like. Examples of semi-solid and liquid carbonaceous materials include coal tars, tar sand, asphalt, shale oil, heavy petroleum oils, light petroleum oils, petroleum residuals, coal derived liquids and the like.

The terms "solvent", "solvent/solute system" and "solvent medium" mean a penetration enhancing or solubilizing medium comprising one or more constituents which may solubilize at least a portion of the carbonaceous material and/or may otherwise enhance liquefaction of the carbonaceous material during practice of the present invention.

The term "liquefaction" means the structural degradation of a carbonaceous material typically, but not necessarily, accompanied by hydrogenation processes or the addition of hydrogen to the molecular structure of the material. Liquefaction according to the present invention may be used to obtain hydrocarbon liquids from solid carbonaceous materials. In addition, hydrocarbon semi-solids and liquids may be further converted, structurally degraded, altered and/or hydrogenated according to the present invention in an effect analogous to the reforming or cracking of liquid hydrocarbons in a hydrocarbon refinery operation. Thus, as used herein, "production or conversion" of hydrocarbon liquids is intended to mean both the production of hydrocarbon liquids and/or gases from solids, the conversion of hydrocarbon solids to other hydrocarbon solids and/or the conversion of semi-solid and liquid hydrocarbons to other liquid hydrocarbons and/or gases.

To facilitate the liquefaction of solid carbonaceous materials, such as coal, it is preferable to comminute the coal prior to treatment according to the method of the present invention. The coal is preferably comminuted to an average top particle size of less than about 40 mesh (350 microns), more preferably to an average top particle size of less than about 100 mesh (147 microns) and most preferably to an average top particle size of less than about 200 mesh (74 microns).

In accordance with one embodiment of the present invention, carbonaceous material is contacted with a liquefaction facilitating agent and water gas to form a reaction mixture or slurry. The pH of the reaction mixture or slurry is maintained above about 7.5, preferably within the range of about 7.5 to about 10.7, and the reaction mixture or slurry is heated to a sufficient temperature and pressure to result in the production or conversion of hydrocarbon liquids, as from hereinbefore defined, from the carbonaceous material. The water gas may be formed by adding water to the reaction mixture or slurry and then heating the reaction mixture in the presence of carbon monoxide or in the presence of a mixture of carbon monoxide and hydrogen, e.g. syngas, by heating the mixture or slurry in the presence of a steam/carbon monoxide mixture, or by other suitable means. Preferably, the water gas will contain on the order of 2.5 moles of water per mole of carbon monoxide, but other quantities of these components are effective in the practice of the invention. Although not essential, in order to insure maximum hydrocarbon liquid production or conversion, a sufficient amount of water and carbon monoxide are preferably provided to satisfy the hydrogen requirements of the liquefaction method. The reaction mixture or slurry preferably further comprises a solvent medium, as is hereinafter further described.

Suitable liquefaction facilitating agents include metal carbonyls, other low valent complexes of the transition metals, derivatives thereof and mixtures thereof. Examples of suitable metal carbonyls include the transition metal carbonyls of Groups V B, VI B, VII B, and VIII of the periodic system. Specific examples include the carbonyls of vanadium, chromium, manganese, iron, cobalt, nickel, molybdenum, ruthenium, palladium, and tungsten. For purposes of safety and economy, the presently preferred metal carbonyls are iron pentacarbonyl, diiron nonacarbonyl and triiron dodecacarbonyl. Other suitable metal complexes include those containing metal atoms in a chemical form close to that of the metallic state. Specific examples of such low valent complexes include the metallocenes, such as ferrocene, although other low valent metal complexes are useful for this purpose. Suitable derivatives include hydrides of the metal carbonyls and metallocenes, modified hydrides, such as salts of the carbonyl hydrides, and other chemically active derivatives of these compounds. Mixtures of metal carbonyls and/or their derivatives, mixtures of low valent metal complexes and/or their derivatives and mixtures of one or more metal carbonyls and one or more other low valent metal complexes and/or their derivatives are also useful as liquefaction facilitating agents. Methylcyclopentadienyl manganese tricarbonyl is one illustrative example of one mixed derivative useful in the practice of the present invention.

Although the precise reaction mechanism is not completely understood at this time, it is presently believed that under moderately basic reaction conditions, iron pentacarbonyl, for example, is hydrolyzed to iron tetracarbonyl hydride anion and/or tetracarbonyl dihydride as follows:

$$Fe(CO)_5 + OH^- \rightleftharpoons HFe(CO)_4^- + CO_2 \quad (1)$$

$$HFe(CO)_4^- + H_2O \rightleftharpoons H_2Fe(CO)_4 + OH^- \quad (2)$$

According to the foregoing reaction scheme, at pH levels less than about 7.5, there may be insufficient hydroxide ion present in the reaction mixture to favor production of iron tetracarbonyl hydride anion according to the reaction of equation (1), above. Similarly, at substantially higher pH levels, for example above about pH 10.7, an excess of hydroxide ion appears to have deleterious effects on the tetracarbonyl hydride shown in equation (1) above.

In order to maintain the reaction mixture or slurry within the desired pH range, it may be necessary to add a suitable base to the aqueous solution. Suitable bases for this purpose include any base which would not have a substantial deleterious effect on the carbonaceous material or the desired reaction conditions. Presently preferred bases include the hydroxides, carbonates and bicarbonates of the alkali metals and the alkaline-earth metals. Specific examples of suitable bases include NaOH, KOH, $Mg(OH)_2$, $Ca(OH)_2$, $Na_2CO_3$, $K_2CO_3$, $NaHCO_3$, $KHCO_3$, $CaCO_3$, mixtures thereof, and the like, although other bases may be employed for this purpose. When the method of the present invention is used in connection with the treatment of acidic carbonaceous materials, the pH of the reaction mixture or slurry will typically decrease after contact with the carbonaceous material. Therefore, the pH of the reaction mixture or slurry may be maintained in the desired range by carefully controlling the addition of base to the reaction mixture, by incorporating suitable pH buffers in the reaction mixture, or by other suitable means.

Although not essential to the treatment method of this embodiment of the invention, it is a presently preferred practice to additionally incorporate a solvent or solvent medium in the reaction mixture or slurry, which may enhance penetration of the liquefaction facilitating agent into the carbonaceous material, may solubilize at least a portion of the carbonaceous material and/or liquefaction facilitating agent, and/or may otherwise enhance liquefaction of the solid carbonaceous material during practice of the present invention. When used, suitable solvents preferably exhibit substantial liquefaction facilitating agent solubility and optimally exhibit substantial water miscibility. Particularly useful solvents have a boiling point in the range of above 30° C., more preferably about 40° C. to about 250° C., and most preferably about 55° C. to about 220° C. Examples of suitable solvents include alkyl alcohols having from one to about six carbon atoms, aromatic hydrocarbons, coal derived liquids, recycle solvents, mixtures thereof and their derivatives. Presently particularly preferred solvents include methanol, ethoxyethanol, tetralin, phenols, cresols, coal derived liquids, and recycle solvent, although other suitable solvents may be employed. The solvent is preferably incorporated into the reaction mixture in a sufficient amount to solubilize at least a portion of the carbonaceous material and/or the liquefaction facilitating agent. When used in connection with solid carbonaceous materials, additional amounts of solvent may be employed to enhance liquefaction facilitating agent penetration into the solid carbonaceous materials. Preferably the solvent may be incorporated in at least about equal volume with the water in the reaction mixture or slurry, more preferably at least about 2 volumes of solvent are incorporated per volume of water, and most preferably at least about 2.5 volumes of solvent are incorporated per volume of water. A sufficient amount of water must be present in the reaction mixture or slurry to permit the reaction of equation (2), above, to proceed.

The amount of liquefaction facilitating agent required in the reaction mixture or slurry is dependent upon the amount and nature of the solid carbonaceous material to be treated. Generally, it is preferable to employ at least about 250 parts by weight of the agent per million parts of solid carbonaceous material, more preferably at least about 2,500 parts of agent per million parts carbonaceous material, and most preferably at least about 25,000 parts agent per million parts carbonaceous material.

The reaction mixture is heated to a sufficient elevated temperature and pressure to obtain production and/or conversion of hydrocarbon liquids, as hereinbefore defined, from the solid carbonaceous material. For most purposes, it is contemplated that sufficient temperature levels are from about 100° C. to a temperature below the decomposition temperature of the liquefaction facilitating agent under the reaction conditions employed, more preferably from about 110° C. to about 750° C., and most preferably from about 120° C. to about 500° C., at an elevated pressure of at least about 100 p.s.i.g., more preferably about 200 to about 2,500 p.s.i.g., and most preferably about 250 to about 1000 p.s.i.g., 1012.5 p.s.i.g. equalling 6.98 MPa. It has been found that under the foregoing reaction conditions, relatively short periods of time result in the production of the desired liquids. Although sufficient times are dependent upon the nature of the carbonaceous material, the reaction conditions employed, and the like, for most purposes it is contemplated that reaction times of at least about 1 minute, more preferably from about 2 to about 120 minutes and most preferably from about 5 to about 30 minutes are sufficient to result in the production and/or conversion of hydrocarbon liquids.

After completion of the reaction, a substantial portion of the produced fluids, including gases and easily removable liquids, may be recovered from any remaining solid materials in the reaction mixture, such as by the use of conventional solid/gas and solid/liquid separation techniques. Further recovery may additionally be obtained from the remaining solids by such techniques as distillation and/or solvent extraction. The recovered hydrocarbon liquids may then be further treated, such as by filtration, centrifugation, distillation, solvent extraction, magnetic separation, solvent de-ashing, and the like, prior to subsequent upgrading, hydrogenation and/or utilization as a hydrocarbon liquid fuel. Preferably, any remaining solid carbonaceous material and the produced liquids are washed, such as with the solvent, to remove any remaining liquefaction facilitating agent and/or to substantially reduce the sulfate sulfur content of the separated carbonaceous material. In a particularly preferred embodiment, any remaining liquefaction facilitating agent and/or solvent are separated from any remaining solid carbonaceous material or produced liquids and are recycled for reuse in the treatment of additional carbonaceous material.

In accordance with the second embodiment of the present invention, carbonaceous material is contacted with a solvent/solute system comprising an organic phase of at least one solubilizing agent, preferably a substituted phenolic-type solvent, such as m-cresol, and an inorganic fraction containing water and compounds of one or more alkali metals or alkaline-earth metals.

The solvent/solute systems useful in the practice of the present invention are solubilizing mediums comprising organic and inorganic fractions or constituents which may solubilize a portion of the carbonaceous material and/or may otherwise enhance liquefaction of the carbonaceous material during practice of the present invention.

Organic fractions of the solvent/solute systems of the present invention comprise one or more solubilizing agents selected from the group consisting of aromatic alcohols, phenolics, e.g. phenols, and polycyclic and/or substituted phenols, typically of from 6 to 15 carbon atoms, e.g. benzyl alcohol, o-cresol, m-cresol, p-cresol, catechol, resorcinol, naphthol, and mixtures and derivatives thereof. Although not essential to the practice of this embodiment of the invention the solvent/solute systems in many instances will include other organic constituents. Suitable organic constituents include polycyclic aromatic hydrocarbons, partially hydrogenated and/or fully hydrogenated polycyclic aromatic hydrocarbons, typically having from 1 to 4 carbon rings, and more preferably from 2 to 3 carbon rings e.g. naphthalene, anthracene, phenanthrene, acenaphthene, 1-methylnaphthalene, 2-methylnaphthalene, tetralin, gamma-picoline, isoquinoline, dihydronaphthalene, decalin; 9,10-dihydroanthracene, 9,10-dihydrophenanthrene, and mixtures and derivatives thereof.

During initial phases of operation, some of the above mentioned solubilizing agents and/or other organic constituents will be present: then in subsequent operation, the organic constituents will be carbonaceous material-derived phenols of the type, and polycyclic aromatic hydrocarbons of the type, or derivatives related to the type, described hereinbefore. Particularly useful organic phase solubilizing agents and/or other organic fraction constituents have a boiling point above 50° C., more preferably of from about 100° to about 460° C., and most preferably of from about 150° C. to about 400° C. In the practice of the subject invention, the solubilizing agent is typically of from about 10 to about 100 weight percent, more usually of from about 15 to about 75 percent by weight of the organic fraction of the solvent/solute system.

Suitable inorganic fraction constituents of the solvent/solute system include water, and alkali and/or alkaline-earth metal compounds, and their derivatives. The water content can be from about 5 parts to about 60 parts per 400 parts by weight of the solvent/solute system, more usually about 15 parts to about 40 parts per 400 parts by weight of the solvent/solute system. Suitable examples of alkali and alkaline-earth metal compounds include hydroxides, carbonates, bicarbonates, nitrates, sulfates, sulfites, sulfides, formates and other salts, mixtures thereof, and the like, although other compounds may be employed for the purpose. Specific examples include NaOH, $Na_2CO_3$, $NaHCO_3$, $Na_2SO_4$, $NaNO_3$, KOH, $K_2CO_3$, $KHCO_2$, $CaCO_3$, mixtures thereof and the like. Presently preferred species are NaOH, KOH and $Na_2CO_3$ in from about 1 part to about 25 parts per 400 parts by weight of the solvent/solute system, more usually 10 parts to about 15 parts per 400 parts by weight of the solvent/solute system. It is understood that the amount of alkali or alkaline-earth metal compound present for purposes of the present invention is an added amount, i.e. an amount in excess of the amount which would be present from the various naturally occurring alkali or alkaline-earth metal compounds. Further, it is understood that the alkali or alkaline-earth metal compound content will be maintained at the desired level in a recycle solvent stream. As will be seen in Example V et seq., the combination of organic and inorganic fractions and constituents provide a beneficially synergistic effect on solubilizing of carbonaceous material.

The amount of the solvent/solute system required in the reaction mixture or slurry is dependent upon the amount and nature of the carbonaceous material to be treated. Generally, it is preferred to employ up to about 500 parts of solvent/solute system to 100 parts of carbonaceous material, more preferably at least about 350 parts of solvent/solute to 100 parts of carbonaceous material, and most preferably at least 250 parts of solvent/solute system to 100 parts of carbonaceous material.

According to this embodiment, carbonaceous material is solubilized in the solvent system—alkali medium to form a reaction mixture or slurry. Frequently, the reaction conditions are water gas shift reaction conditions, as hereinbefore described.

The reaction mixture is heated to a sufficient temperature, typically below about 450° C., and pressure to obtain enhanced solubilizing of the carbonaceous material for production and/or conversion of hydrocarbon liquids, as hereinbefore defined, from the carbonaceous material. For most purposes, it is contemplated that sufficient temperature levels are from about 100° C. to a temperature below the decomposition temperature of the solvent/solute system under the reaction conditions employed, more preferably from about 140° C. to about 450° C., and most preferably from about 260° C. to about 350° C., at a pressure of at least about 400 p.s.i.g., more preferably from about 500 p.s.i.g. to about 2500 p.s.i.g., and most preferably from about 750 p.s.i.g. to about 2000 p.s.i.g. It has been found that under the foregoing reaction conditions, relatively short periods of time result in the production of the desired product. Although sufficient times are dependent upon the nature of the carbonaceous material, the reaction conditions employed, and the like, for most purposes, it is contemplated that reaction times of at least about 1 minute, more preferably from about 10 minutes to about 120 minutes, and most preferably from about 15 minutes to about 60 minutes are sufficient to result in enhanced solubilizing and the production and/or conversion of hydrocarbon liquids.

As will be known and understood by those skilled in the art, the solvent/solute systems containing coal or other carbonaceous material solubilized according to the present invention, may be further treated by known processes for purposes of upgrading the liquids so produced, e.g. by subsequent stages of hydrogenation or catalytic upgrading and the like, including methods using incorporation of the metal carbonyl or a low valent complex of the transition metal type liquefaction facilitating agents hereinbefore described.

The foregoing may be further understood in connection with the following examples.

EXAMPLE I

Coal obtained from the No. 6 Seam, Ohio is preprocessed in a conventional gravity separation, screening and drying process, and is then pulverized to a top particle size of 40 mesh. A 300 cc. Magnedrive autoclave, manufactured by Autoclave Engineers, Erie, Pa., is charged with 50 g. of pulverized coal, 75 g. of methanol and 25 g. of water. The autoclave is sealed and pressure tested, and then charged with 390 p.s.i.g. of carbon monoxide. The reaction mixture is heated to a temperature of 140° to 150° C. for a reaction period of two hours. At the reaction temperature, the pressure in the autoclave is observed to be in the range of 556 to 580 p.s.i.g. Upon termination of the reaction period, the heater jacket is removed from the autoclave and the autoclave is rapidly cooled using forced air convection. A gas sample is then removed from the autoclave and analyzed with a Carle Model 111H refinery gas analyzer. The solid and liquid components are removed from the autoclave and separated by centrifugation.

The foregoing procedure is repeated except with the addition of 2.5 g. of iron pentacarbonyl and 12.5 g. of potassium hydroxide to the reaction mixture.

The reaction yield is estimated by extracting the solid and liquid products with tetrahydrofuran (THF) from the following equation:

$$Y = 100 - \frac{O_{THF} \times A_C \times 100}{A_{THF} \times (100 - A_C)}$$

$Y$ = *MAF* yield (moisture and ash-free yield)
$O_{THF}$ = weight of organics in the *THF* insolubles
$A_{THF}$ = weight of ash in the *THF* insolubles
$A_C$ = percentage of ash in the coal by weight The results of the solid and liquid product analysis are shown in the following Table I, and the results of the gas sample are shown in Table II:

TABLE I

| | % by Weight | |
|---|---|---|
| | Without Added $Fe(CO)_5$ and KOH | With Added $Fe(CO)_5$ and KOH |
| MAF yield | 0 | 6.9 |
| THF Solubles Sulfur | Trace | Trace |

TABLE II

| | Mole % | |
|---|---|---|
| Component | Without Added $Fe(CO)_5$ and KOH | With Added $Fe(CO)_5$ and KOH |
| $H_2$ | 0.9 | 53.9 |
| CO | 97.5 | 36.4 |
| $CO_2$ | 1.0 | 9.5 |
| $CH_4$ | 0.5 | 0.2 |
| $H_2S$ | 0.1 | N.A. |

In addition to the foregoing, it is noted that where iron pentacarbonyl and potassium hydroxide are not added to the reaction mixture, the separated produced liquids are lightly colored yellow and the separated solids have the appearance of the feed coal. Where iron pentacarbonyl and potassium hydroxide are added to the reaction mixture, the produced liquids are black and contain finely dispersed carbonaceous particles, while the separated solids have the appearance of being comminuted by the treatment process.

EXAMPLE II

The foregoing procedure is repeated using 50 g. of pulverized coal, 90 g. of tetralin and 10 g. of water in the reaction mixture and then charging the autoclave with 890 p.s.i.g. of carbon monoxide. The reaction mixture is heated to a temperature of 395°-405° C. for a period of two hours. At the reaction temperature, the pressure in the autoclave is observed to be within the range of 2450 to 2520 p.s.i.g.

This reaction is repeated with the addition of 2.5 g. iron pentacarbonyl and 12.5 g. potassium hydroxide to the reaction mixture. The solid and liquid analysis of these runs is shown in the following Table III, and the gas sample analysis of these runs is shown in Table IV:

TABLE III

| | % by Weight | |
|---|---|---|
| | Without Added $Fe(CO)_5$ and KOH | With Added $Fe(CO)_5$ and KOH |
| MAF conversion | 92.5 | 93.3 |
| THF Solubles Sulfur | 0.15 | 0.06 |

TABLE IV

| | Mole % | |
|---|---|---|
| Component | Without Added $Fe(CO)_5$ and KOH | With Added $Fe(CO)_5$ and KOH |
| $H_2$ | 19.34 | 37.16 |
| CO | 55.92 | 33.91 |
| $CO_2$ | 17.60 | 22.06 |
| $CH_4$ | 4.55 | 4.61 |
| $C_2H_6$ | 1.19 | 1.12 |
| $C_3H_6$ | 0.08 | 0.12 |
| $C_3H_8$ | 0.49 | 0.78 |
| i-$C_4$ | 0.02 | 0.10 |
| n-$C_4$ | 0.06 | 0.12 |
| $H_2S$ | 0.77 | N.A. |

When the reaction is carried out without added iron pentacarbonyl and potassium hydroxide, the reaction products are a heavy black tar. With added iron pentacarbonyl and potassium hydroxide, however, the reaction products are a free flowing liquid at room temperature having the odor of light hydrocarbons.

EXAMPLE III

The foregoing procedure is repeated using 50 g. of pulverized coal, 90 g. of tetralin and 10 g. of water in the reaction mixture and then charging the autoclave with 800 p.s.i.g. of carbon monoxide. The reaction mixture is heated to a temperature of 400° to 410° C. for a period of 10 minutes. At the reaction temperature, the pressure in the autoclave is observed to be within the range of 2440 to 2580 p.s.i.g.

This reaction is repeated with the addition of 2.5 g. of iron pentacarbonyl and 12.5 g. of potassium hydroxide to the reaction mixture. The solid and liquid analysis of these runs is shown in the following Table V and the gas sample analysis is shown in Table VI:

TABLE V

| | % by Weight | |
|---|---|---|
| | Without Added $Fe(CO)_5$ and KOH | With Added $Fe(CO)_5$ and KOH |
| MAF conversion | 81.3 | 82.2 |
| THF Solubles Sulfur | 0.17 | 0.08 |

TABLE VI

| | Mole % | |
|---|---|---|
| Component | Without Added $Fe(CO)_5$ and KOH | With Added $Fe(CO)_5$ and KOH |
| $H_2$ | 7.13 | 35.31 |
| CO | 83.43 | 40.78 |
| $CO_2$ | 6.19 | 15.28 |
| $CH_4$ | 1.60 | 6.28 |
| $C_2H_4$ | 0.30 | 0.32 |
| $C_2H_6$ | 0.69 | 1.39 |
| $C_3H_6$ | 0.05 | 0.08 |
| $C_3H_8$ | 0.17 | 0.51 |
| i-$C_4$ | Trace | 0.01 |
| n-$C_4$ | 0.02 | 0.03 |
| $H_2S$ | 0.37 | N.A. |

The reaction products obtained in the absence of added iron pentacarbonyl and potassium hydroxide are a heavy black tar with a granular appearance, while those obtained in the presence of added iron carbonyl and potassium hydroxide are a smooth gelatinous tar covered by a layer of light oil.

EXAMPLE IV

The foregoing procedure is repeated in a first run (Run 1) using 50 g. of pulverized coal, 75 g. of methanol, 25 g. of water, 2.5 g. of iron pentacarbonyl and 12.5 g. of potassium hydroxide in the reaction mixture, and then charging the autoclave with 312 p.s.i.g. of carbon monoxide. The reaction mixture is heated to a temperature of 225° to 230° C. for two hours. At the reaction temperature, the pressure in the autoclave is observed to be 490 to 525 p.s.i.g.

The foregoing procedure is repeated in a second and third run (Runs 2 and 3), conducted in a 1000 cc autoclave, using 50 g. of pulverized coal, 150 g. of methanol, 52 g. of water, and 12.5 g. of potassium hydroxide in the reaction mixture. The reaction mixture of Run 2 also contains 2.5 g. of iron pentacarbonyl. The autoclave is charged with 550 p.s.i.g. of carbon monoxide and each reaction mixture is heated to a temperature of 230° C. for a period of two hours. At the reaction temperature, the pressure in the autoclave for Runs 2 and 3 is observed to be 1130 to 1280 p.s.i.g. and 1025 to 1100 p.s.i.g., respectively. At periodic intervals approximately 3 ml. thief samples are taken from the reaction mixture of Runs 2 and 3, and are analyzed for hydrogen to carbon ratio of the THF soluble, pentane insoluble, fraction (H/C) of the samples.

The solid and liquid analysis of these runs is shown in the following Table VII, the gas sample analysis results are shown in Table VIII, and the hydrogen to carbon atomic ratios of the THF soluble, pentane insoluble, fractions of samples from Runs 2 and 3 are shown in Table IX:

TABLE VII

| | Wt % | | |
|---|---|---|---|
| | Run 1 | Run 2 | Run 3 |
| MAF Conversion | 28.82 | 30.8 | 22.4 |
| Preasphaltenes | 3.41 | | |
| Asphaltenes | 4.10 | | |
| Oil | 21.31 | | |
| THF Insolubles Ash | 16.28 | | |

TABLE VIII

| | Mole % | | |
|---|---|---|---|
| Component | Run 1 | Run 2 | Run 3 |
| $H_2$ | 4.98 | 30.82 | 2.58 |
| CO | 90.42 | 55.21 | 94.49 |
| $CO_2$ | 4.40 | 13.66 | 2.93 |
| $CH_4$ | 0.14 | 0.27 | |
| $H_2S$ | 0.06 | | |

TABLE IX

| Time From | H/C | |
|---|---|---|
| Start (min.) | Run 2 | Run 3 |
| 15 | 0.84 | 0.62 |
| 30 | | 0.76 |
| 60 | 0.87 | 0.82 |
| 120 | 0.90 | 0.83 |

The feed coal is found to have a hydrogen to carbon atomic ratio of 0.84. The reaction products of Run 3 are noted after air drying to have the appearance of an amorphous filter cake. The products of Run 1 have the appearance of a heavy tar covered by a light oil, while those of Run 2 have the appearance of a heavy tar covered by a heavier oil. The hydrogen to carbon ratio of the THF soluble fraction of the products of Run 1 is found to be 1.53, and the nitrogen content of that fraction is found to be 0.8 percent as compared to 1.34 percent in the feed coal.

EXAMPLE V

A hvBb coal obtained from the Ohio No. 6 Seam is preprocessed in a conventional gravity separation, screening and drying process, and is pulverized to a top size of about −200 mesh (−74 microns). A semi-batch liquefaction unit comprising a gas delivery system, a reactor system, and a gas measurement system is charged with 100 g. of pulverized coal and 360 g. of m-cresol. The semi-batch coal liquefaction unit is designed for continuous flow of gas, and for batch injection of solid-liquid slurries. Gas is fed to the liquefaction unit from pressurized gas bottles which are premixed with 5% argon and 95% carbon monoxide. The gas delivery system is equipped with pressure regulators, and flow controllers to maintain 1000 p.s.i.g. (6.98 MPa) at 0.5–3 standard liters per minute (SLM) of gas flow. The reactor system consists of a 316 stainless steel, one-liter Magnedrive Autoclave manufactured by Autoclave Engineers, Erie, Pa., and an iron-constantan thermocouple connected to an Omega Model 400A temperature indicator. The heater temperature is controlled by a Fenwall Series 5501552 temperature controller. Gas flow enters the reactor through the stirrer and exits through a knockback condensor consisting of a ¾-inch O.D. stainless steel tube in a water jacket. The gas measurement system consists of a Rockwell Model S-200 diaphragm meter for measurement of total gas volume, a Carle Series "S" chromatograph for analysis of carbon monoxide, carbon dioxide, hydrogen and argon tracer, and a Hewlett-Packard 3390 integrator to calculate and print the gas composition in mole percents. The semi-batch liquefaction reactor system is pressure tested at 1000 p.s.i.g. (6.98 MPa) with helium and then the premixed argon and carbon monoxide gas is introduced and the reactor is heated to 300° C. (573 K.). After the reactor temperature and pressure are maintained for the desired reaction time, 120 minutes in this instance, the heater jacket is removed and the autoclave is cooled using forced air convection. The solid and liquid components are removed from the reactor and mixed in a high speed blender. Samples are removed from the blender and placed in 250 ml. centrifuge tubes. The samples are subjected to an empirical selective solvent extraction procedure using tetrahydrofuran (THF), toluene, and pentane to determine total conversion, preasphaltenes, asphaltenes, and oil plus gas.

The yield and product structure are defined by:

$$\text{Yield} = 100 - \frac{\text{Grams } MAF\ THF \text{ Insoluble Material}}{\text{Grams } MAF \text{ Coal}}(100), [=] \text{ wt } \% \quad (4)$$

$$\text{Preasphaltenes } (PA) = \frac{\text{Grams } MAF \text{ Toluene Insoluble Material}}{\text{Grams } MAF \text{ Coal}}(100), [=] \text{ wt } \% \quad (5)$$

$$\text{Asphaltenes } (A) = \frac{\text{Grams } MAF \text{ Pentane Insoluble Material}}{\text{Grams } MAF \text{ Coal}}(100), [=] \text{ wt } \% \quad (6)$$

$$\text{Oil plus Gas } (O + G) = \text{Yield} - PA - A, [=] \text{ wt } \% \quad (7)$$

The results of the selective solvent extraction procedure are shown in Table X. Results of the gas analysis showed 93.52 percent carbon monoxide, 0.66 percent hydrogen and 0.3 percent carbon dioxide.

EXAMPLE VI

The foregoing procedure is repeated using 100 g. of the hvBb Ohio No. 6 coal, 360 g. of m-cresol, 40 g. of water, 1000 p.s.i.g. (6.98 MPa), 300° C. (573 K), 0.5 SLM of 95 percent carbon monoxide and 5 percent argon, and 120 minutes. The semi-batch liquefaction unit is charged, heated and the products analyzed as previously described. The results of the selective solvent extraction procedure are shown in Table X and results of the gas analysis showed 92.45 percent carbon monoxide, 0.81 percent hydrogen, and 1.15 percent carbon dioxide.

EXAMPLE VII

The foregoing procedure of Example V is repeated using 100 g. of the hvBb Ohio No. 6 coal, 360 g. of m-cresol, 40 g. of water, 25 g. of potassium hydroxide, 1000 p.s.i.g. (6.98 MPa), 300° C. (573 K), 0.5 SLM of 95 percent carbon monoxide and 5 percent argon, and 120 minutes. The semi-batch liquefaction unit is charged, heated, and the products analyzed as previously described. The results of the selective solvent extraction procedure are shown in Table X, and results of the gas analysis showed 54.54 percent carbon monoxide, 19.44 percent hydrogen, and 21.44 percent carbon dioxide.

TABLE X

| Example | Solvent/Solute System: Organic Phase Solubilizing Agent | Inorganic Phase Alkali/Alkaline-Earth Compound | Water | MAF Conversion Wt % |
|---|---|---|---|---|
| V | 360 g. m-cresol | 0 | 0 | 40.0 |
| VI | 360 g. m-cresol | 0 | 40 g. | 39.0 |
| VII | 360 g. m-cresol | 25 g. KOH | 40 g. | 82.5 |

EXAMPLE VIII

The foregoing procedure of Example V is repeated using 100 g. of a hvCb Colorado Wadge coal, 360 g. of a synthetic recycle solvent consisting of 270 g. of m-cresol, 60 g. of 1,2,3,4-tetrahydronaphthalene, 20 g. of naphthalene, and 10 g. of 1-methylnaphthalene, 40 g. of water, 1000 p.s.i.g. (6.98 MPa), 300° C. (573 K), 0.5 SLM of 95 percent carbon monoxide and 5 percent argon, and 120 minutes. The semi-batch liquefaction unit is charged, heated, and the products analyzed as previously described. The results of the selective solvent extraction procedure are shown in Table XI, and the exit gas was not analyzed.

EXAMPLE IX

The foregoing procedure of Example V is repeated using 100 g. of a hvCb Colorado Wadge coal, 40 g. of water, 15 g. of sodium hydroxide, and the temperature, pressure, gas composition and flow rates, and residence time of Example VIII. The semi-batch liquefaction unit is charged, heated, and the products analyzed as previously described. The results of the selective solvent extraction procedure are shown in Table XI, and the exit gas was not analyzed.

EXAMPLE X

The foregoing procedure of Example IX was repeated, except 15 g. of sodium carbonate was used replacing the 15 g. of sodium hydroxide. The semi-batch liquefaction unit is heated, charged, and the products analyzed as previously described. The results of the selective solvent extraction procedure are shown in Table XI.

TABLE XI

| Example | Solvent/Solute System: Organic Phase Solubilizing Agent | Inorganic Phase Alkali/Alkaline-Earth Compound | Water | MAF Conversion Wt % |
|---|---|---|---|---|
| VIII | 360 g. synthetic solvent | 0 | 40 g | 22.8 |
| IX | 360 g. synthetic solvent | 15 g NaOH | 40 g | 60.5 |
| X | 360 g. synthetic | 15 g $Na_2CO_3$ | 40 g | 60.1 |

TABLE XI-continued

| Example | Solvent/Solute System: Organic Phase Solubilizing Agent | Inorganic Phase Alkali/Alkaline-Earth Compound | Water | MAF Conversion Wt % |
|---|---|---|---|---|
| | solvent | | | |

The results in Tables X and XI demonstrate the significantly improved results obtained by practice of the present invention. Table X shows that the presence of the organic phase solubilizing agent, m-cresol, in the absence of the inorganic phase constituent as Example V, yields a MAF conversion of 40 wt %. In the case of Example VI, with the addition of water, the MAF conversion is 39 wt %, which is virtually unchanged from Example V. In Example VII, under operating conditions of Examples V and VI, the synergistic effect of the alkali/alkaline-earth constituent is observed as the yield is increased to 82.52 MAF wt %. In Examples VIII, IX and X, the organic phase solubilizing agent is a synthetic solvent which is considered to represent a recycle stream in a continuous liquefaction facility. The MAF wt % yields for Examples IX and X, when compared to Example VIII, show the increased synergistic effect obtained by the combination of the inorganic and organic phase constituents.

EXAMPLE XI

The foregoing procedure of Example V is repeated using 180 g. of a hvCb Colorado Eagle No. 5 coal. The organic fraction of the solvent/solute system is 360 g. of synthetic solvent consisting of 160 g. of m-cresol, 160 g. of tetralin, 20 g. of naphthalene, 10 g. of 1-methylnaphthalene, and 10 g. of gamma-picoline. The inorganic fraction of the solvent/solute system is 30 g. of water, 18 g. of NaOH, 4.5 g. of $Na_2CO_3$, and 30 g. of $Na_2S.9H_2O$. The feed materials are reacted at 340° C. (613 K), 1300 p.s.i.g. (8.99 MPa), 0.5 SLM of 95 percent carbon monoxide and 5 percent argon for 30 minutes. The results of the selective solvent extraction procedure are shown in Table XII; the exit gas is not analyzed.

EXAMPLE XII

The foregoing procedure of Example XI is repeated, except that the organic fraction of the solvent/solute system is 360 g. of a synthetic solvent consisting of 260 g. of m-cresol, 60 g. of tetralin, 20 g. of naphthalene, 10 g. of 1-methylnaphthalene, and 10 g. of gamma-picoline. The results of the selective solvent extraction procedure are shown in Table XII and the exit gas is not analyzed.

TABLE XII

| Example | MAF Conversion |
|---|---|
| XI | 66.3 |
| XII | 73.8 |

Examples XI and XII show that acceptable liquefaction yields can be obtained when the inorganic fraction of the solvent/solute system consists of a mixture of alkaline/alkaline-earth metal compounds. They also show the importance of phenolic compounds in the organic fraction of the solvent/solute system. In Examples XI, where m-cresol is 44.4 percent of the organic fraction, the yield is 66.27 percent. In Example XII, m-cresol is increased to 72.2 percent of the organic fraction, the yield is increased to 73.82 percent.

The mineral contents of coals used in Examples I through XII are presented in Table XIII:

TABLE XIII

| Coal | Minerals (Wt %): $Fe_2O_3$ | $Na_2O$ | $K_2O$ | $Al_2O_3$ | $SiO_2$ | CaO | MgO |
|---|---|---|---|---|---|---|---|
| Eagle #5 | 7.21 | 1.89 | 1.47 | 24.5 | 55.2 | 3.83 | 1.79 |
| Ohio #6 | 18.30 | .81 | 2.70 | 25.1 | 51.2 | — | — |
| Wadge | 4.09 | .62 | .84 | 27.4 | 60.5 | 4.23 | .79 |

The invention has heretofore been described in connection with various presently preferred, illustrative embodiments. Various modifications may be apparent from this description. Any such modifications are intended to be within the scope of the appended claims, except insofar as precluded by the prior art.

What is claimed is:

1. A method of converting carbonaceous materials to liquid products under conditions of temperature and pressure which do not produce significant thermal bond rupture in the carbonaceous materials consisting essentially of:

contacting the carbonaceous material with a solvent/solute system consisting of:

(a) an organic phase solubilizing agent containing more than 50% by weight of a member selected from the group consisting of aromatic phenols, polycyclic phenols, substituted phenols and mixtures thereof; and (b) an inorganic phase comprising an aqueous solution of a compound having a cation selected from the group consisting of alkali and alkaline-earth metals at a temperature less than about 350° C. and a pressure of at least 400 psig.

2. A method according to claim 1 wherein said organic phase solubilizing agent is selected from the group consisting of, o-cresol, m-cresol, p-cresol, catechol, resorcinol, naphthol and mixtures and derivatives thereof.

3. A method according to claim 1 wherein said organic phase further comprises one or more organic constituents selected from the group consisting of polycyclic aromatic hydrocarbons, partially-hydrogenated polycyclic aromatic hydrocarbons and fully hydrogenated polycyclic aromatic hydrocarbons having from 1 to 4 carbon rings.

4. A method according to claim 3 wherein said organic constituent is selected from the group consisting of naphthalene, anthracene, phenanthrene, acenaphthalene, 1-methylnaphthalene, 2-methylnaphthalene, tetralin, gamma-picoline, isoquinoline, dihydronaphthalene, decalin, 9,10-dihydroanthracene, 9,10-dihydrophenanthrene and mixtures and derivatives thereof.

5. A method according to claims 1, 2, 3 or 4 wherein said organic fraction is in whole or in part derived from liquefied carbonaceous material.

6. A method according to claim 1 wherein said compound in the inorganic phase is selected from the group consisting of alkali hydroxides, alkali carbonates, alkali bicarbonates, alkali nitrates, alkali sulfates, alkali sulfites, alkali sulfides, alkali formates and other alkali salts, alkaline-earth hydroxides, alkaline-earth carbonates, alkaline-earth bicarbonates, alkaline-earth nitrates, alkaline-earth sulfates, alkaline-earth sulfites alkaline-earth sulfides, alkaline-earth formates and other alkaline-earth salts, and mixtures thereof.

7. A method acording to claim 6 wherein said inorganic fraction compound is selected from the group consisting of sodium hydroxide, sodium carbonate, sodium bicarbonate, sodium sulfate, sodium sulfide, sodium nitrate, potassium hydroxide, potassium carbonate, potassium bicarbonate, potassium formate, calcium carbonate and mixtures thereof.

8. A method according to claim 6 wherein said inorganic fraction compound is present in an amount from about 1 part to about 25 parts per 400 parts by weight of the solvent/solute system.

9. A method according to claim 8 wherein said inorganic fraction compound is present in an amount from about 10 parts to about 15 parts per 400 parts by weight of the solvent/solute system.

10. A method according to claim 1 wherein said water is present in an amount from about 5 parts to about 60 parts per 400 parts by weight of the solvent-/solute system.

11. A method according to claim 10 wherein the aqueous phase includes water present in an amount of from about 15 parts to about 40 parts per 400 parts by weight of the solvent/solute system.

12. A method according to claim 1 wherein said solubilizing agent has a boiling point from about 50° C. to about 400° C. and is present in an amount from about 10 to about 100 wt % of the organic fraction of the solvent-/solute system.

13. A method according to claim 12 wherein said solubilizing agent is present in an amount from about 15 to about 75% by weight of the organic fraction of the solvent/solute system.

14. A method according to claim 1 wherein said contacting takes place at a temperature of from about 100° C. to a temperature below the decomposition temperature of the solvent/solute system and at a pressure of from at least about 400 p.s.i.g. to about 2500 p.s.i.g. and for a time period sufficient to result in hydrocarbon liquids from said carbonaceous material.

15. A method according to claim 14 wherein said temperature is from about 140° C. to about 450° C. and said pressure is at least about 400 p.s.i.g.

16. A method according to claim 15 wherein said temperature is from about 260° C. to about 350° C.

17. A method according to claim 16 wherein said pressure is from about 750 p.s.i.g. to about 2000 p.s.i.g.

18. A method of converting carbonaceous materials to liquid products under conditions of temperature and pressure which do not produce significant thermal bond rupture in the carbonaceous materials, the method consisting essentially of:

contacting the carbonaceous material with an excess of a solvent/solute system in the range of from about 2.5 to 1 to 5 to 1 solvent/solute to carbonaceous material, such solvent/solute system consisting of:

(a) an organic phase solubilizing agent containing more than 50% by weight of a member selected from the group consisting of aromatic phenols, polycyclic phenols, substituted phenols and mixtures thereof; and (b) an inorganic phase comprising an aqueous solution of a compound having a cation selected from the group consisting of alkali and alkaline-earth metals at a temperature less than about 350° C. and a pressure of at least 400 psig.

19. The method of claim 18 wherein the step of contacting the carbonaceous material with a solvent/solute system is in the presence of carbon monoxide.

* * * * *